US009027461B2

(12) United States Patent
Wu

(10) Patent No.: US 9,027,461 B2
(45) Date of Patent: May 12, 2015

(54) RODLESS POWER CYLINDER

(71) Applicant: Chanto Air Hydraulics Co., Ltd, Taichung (TW)

(72) Inventor: Tsai-Chao Wu, Taichung (TW)

(73) Assignee: Chanto Air Hydraulics Co., Ltd., Taichung (TW)

( * ) Notice: Subject to any disclaimer, the term of this patent is extended or adjusted under 35 U.S.C. 154(b) by 323 days.

(21) Appl. No.: 13/668,016

(22) Filed: Nov. 2, 2012

(65) Prior Publication Data

US 2014/0123845 A1 May 8, 2014

(51) Int. Cl.

| | |
|---|---|
| ***F01B 29/00*** | (2006.01) |
| ***F01B 31/12*** | (2006.01) |
| ***F15B 15/08*** | (2006.01) |
| *F01L 25/04* | (2006.01) |
| *F15B 15/22* | (2006.01) |
| *F15B 15/28* | (2006.01) |

(52) U.S. Cl.

CPC ..... *F15B 15/086* (2013.01); *F01L 25/04* (2013.01); *F15B 15/223* (2013.01); *F15B 15/2807* (2013.01); *F15B 2211/7725* (2013.01)

(58) Field of Classification Search

CPC ..... F15B 9/03; F15B 15/086; F15B 15/2807; F15B 15/2861

USPC ..... 92/5 R, 88

See application file for complete search history.

(56) References Cited

U.S. PATENT DOCUMENTS

| | | | | | |
|---|---|---|---|---|---|
| 4,488,477 | A | * | 12/1984 | Miyamoto | 92/85 R |
| 5,844,340 | A | * | 12/1998 | Noda | 92/88 |
| 5,953,976 | A | * | 9/1999 | Bueter | 91/1 |
| 6,000,314 | A | * | 12/1999 | Masuda et al. | 91/396 |

* cited by examiner

*Primary Examiner* — Michael Leslie

(74) *Attorney, Agent, or Firm* — Muncy, Geissler, Olds & Lowe, P.C.

(57) ABSTRACT

A rodless power cylinder includes a cylinder body, a piston assembly adapted to reciprocate in the cylinder body, a magnet mounted at each of the two ends of the piston assembly, a valve mounted at each of the two ends of the cylinder body for guiding a flow of air or fluid in and out of the cylinder body to cause the piston assembly to reciprocate, a magnetic sensor mounted in a sensor mounting groove at each of the two valves for sensing the position of the respective magnet, a movable member mounted around the cylinder body and coupled to the piston assembly by a magnetic force for synchronous reciprocating motion.

6 Claims, 3 Drawing Sheets

RODLESS POWER CYLINDER

BACKGROUND OF THE INVENTION

1. Field of the Invention

The present invention relates to power cylinder and more particularly, to a rodless power cylinder.

2. Description of the Related Art

A rodless power cylinder is known comprising a cylinder body, a piston assembly mounted inside the cylinder body, a movable member mounted around the cylinder body to carry a machine and coupled with a magnetic coupling thereof to a magnetic coupling of the piston assembly by a magnetic force for synchronous reciprocation with the piston assembly. This design of rodless power cylinder has neither means to effectively control the reciprocating motion and positioning of the piston assembly subject to the operation of the machine that is carried by the movable member, nor means to accurately control feeding and discharge of a compressed flow of air or fluid into or out of the cylinder body in causing the piston assembly to reciprocate, nor sensor means to sense the position of the magnet at each of two opposite ends of the piston assembly for accurately buffering or correcting the reciprocating motion of the piston assembly.

Further, attached means, for example, touch control switch means or laser link optical switch means may be provided at each of the two opposite ends of the cylinder body for controlling a respective valve to supply a compressed flow of air or fluid into the inside of the cylinder body or to discharge the compressed flow of air or fluid out of the cylinder body, thereby controlling the reciprocating motion of the piston assembly accurately subject to the operation of the machine that is carried on the movable member around the cylinder body. However, this measure cannot eliminate human errors to ensure accurate control of the reciprocating motion of the piston assembly, resulting in low performance. Therefore, there is still room for improvement.

In view of the aforesaid problems, it is desirable to provide ideal and effective means for controlling relative actions between valves and movable member of a rodless power cylinder.

SUMMARY OF THE INVENTION

The present invention has been accomplished under the circumstances in view. It is the main object of the present invention to provide a rodless power cylinder, which has a magnetic sensor mounted in a sensor mounting groove at each valve at each of two opposite ends thereof for sensing the position of the piston assembly to control relative action between the movable member and the valves.

To achieve this object of the present invention, a rodless power cylinder comprises a cylinder body, a piston assembly, which is movable back and forth in the cylinder body, comprising a rod shaft, a magnetic coupling mounted around the rod shaft, two pistons mounted at the rod shaft at two opposite sides relative to the magnetic coupling of the piston assembly and two magnets respectively located at the two distal ends of the rod shaft, two valves respectively mounted in the two distal ends of the cylinder body, each valve comprising an air hole for guiding a flow of air or fluid in and out of the cylinder body, a sensor mounting groove and a magnetic sensor mounted in the sensor mounting groove for sensing one respective magnet, and a movable member, which is mounted around the periphery of the cylinder body, comprising a magnetic coupling secured to the magnetic coupling of the piston assembly by a magnetic force for enabling the movable member to be reciprocated with the piston assembly.

Further, the sensor mounting groove is located on one end face of the respective valve, and extended from an outer thread around the periphery of the respective valve to a second buffer chamber in the respective valve. Further, the piston assembly further comprises two locating rods respectively extended from the two distal ends of the rod shaft, and a magnet affixed to each of the locating rods. Further, each valve comprises a back cover mounted at an outer edge of one end of the cylinder body. The second buffer chamber of each valve is defined in the back cover of the respective valve. Further, each magnet of the piston assembly is sensible by the respective magnetic sensor when enters the second buffer chamber of the respective valve.

Other and further benefits, advantages and features of the present invention will be understood by reference to the following specification in conjunction with the accompanying drawings, in which like reference characters denote like elements of structure.

DETAILED DESCRIPTION OF THE INVENTION

Figure 1:
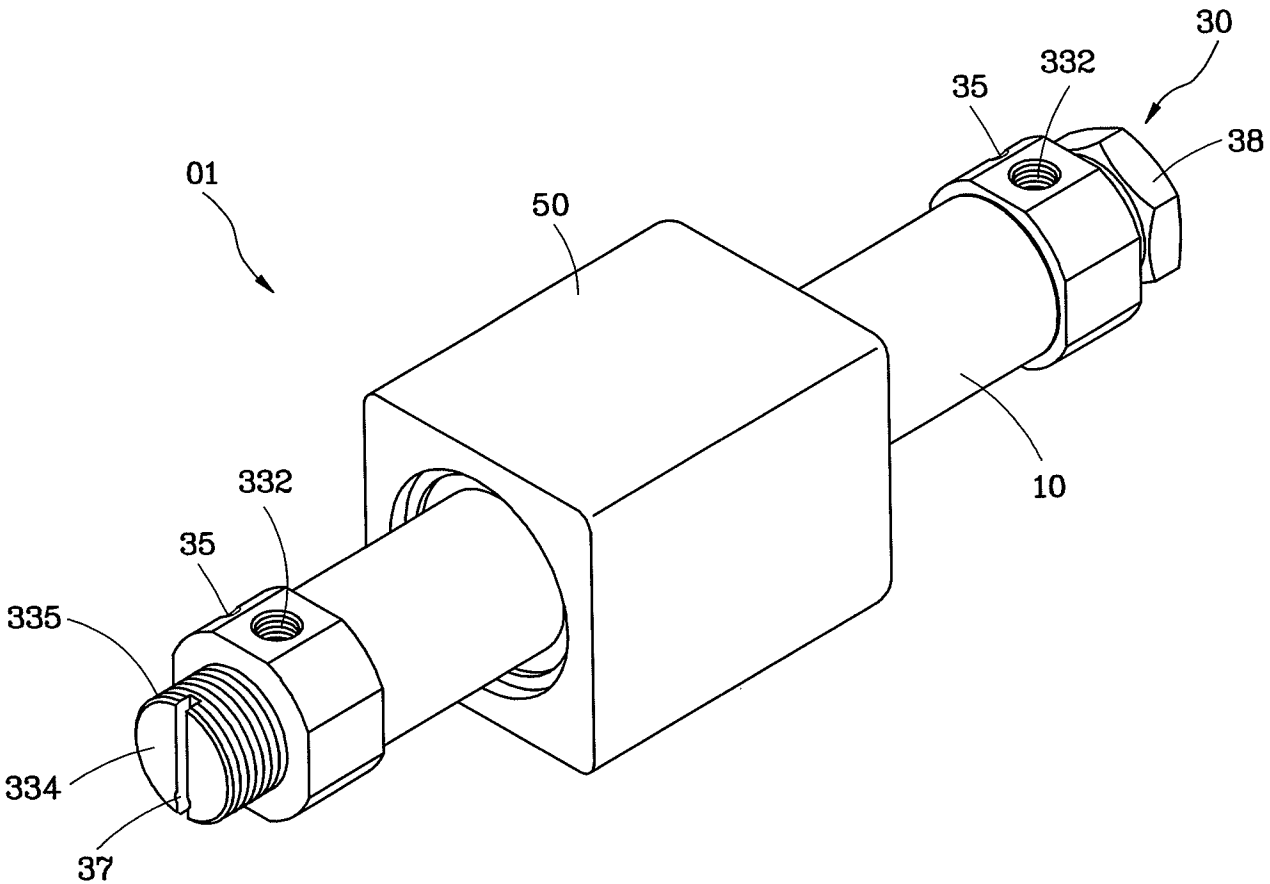
FIG. 1 is an elevational view of a rodless power cylinder in accordance with the present invention.
Figure 2:
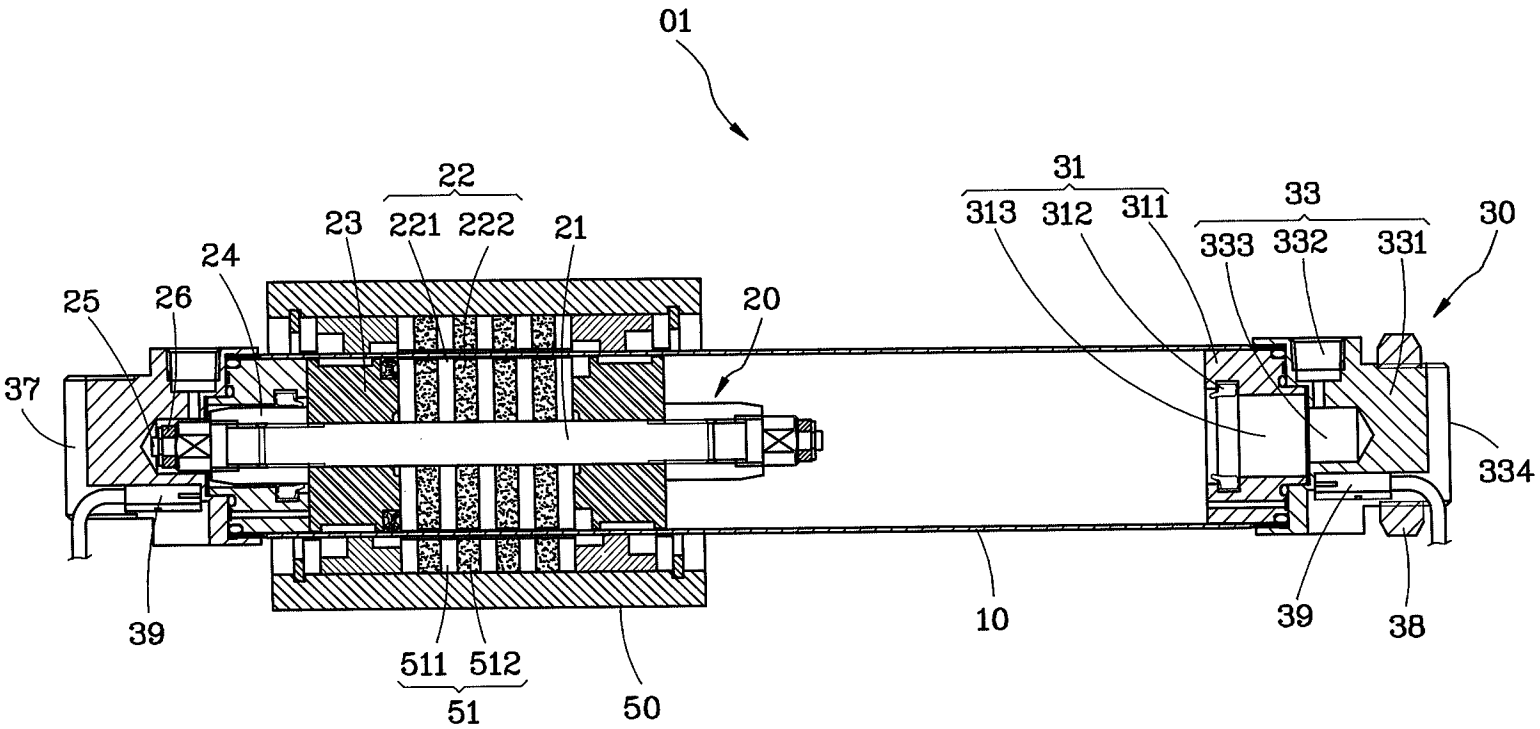
FIG. 2 is a sectional view of the rodless power cylinder in accordance with the present invention.
Figure 3:
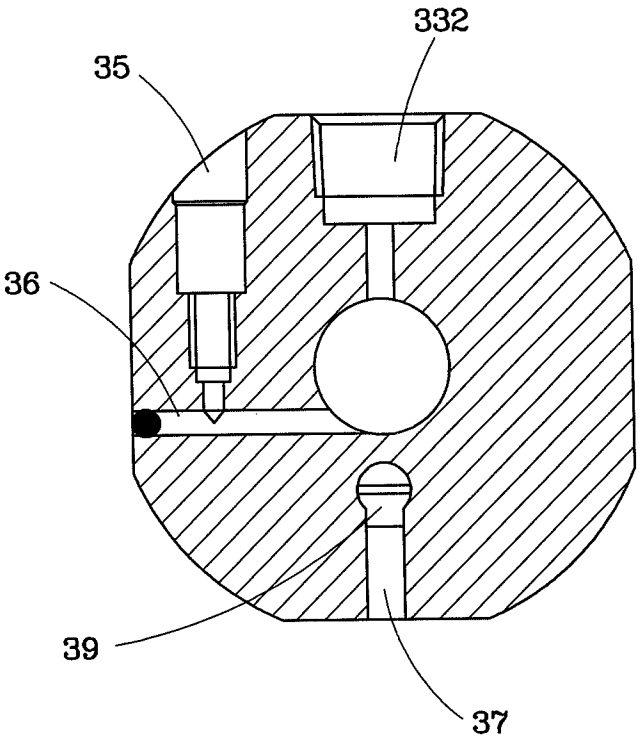
FIG. 3 is an end view of the rodless power cylinder in accordance with the present invention.

As shown in FIGS. 1-3, a rodless power cylinder in accordance with the present invention is shown comprising a cylinder body 10, a piston assembly 20, two valves 30, and a movable member 50.

The piston assembly 20 is movable back and forth in the cylinder body 10, comprising a rod shaft 21, a magnetic coupling 22 formed of alternatively arranged circular yokes 221 and circular magnets 222 and disposed around the rod shaft 21, two annular pistons 23 respectively mounted at the rod shaft 21 near the two distal ends of rod shaft 21, two buffer sleeves 24 respectively mounted at the two distal ends of the rod shaft 21 and respectively disposed adjacent to the annular pistons 23 at an outer side, two locating rods 25 respectively extended from the two distal ends of the rod shaft 21, and a magnet 26 affixed to each locating rod 25. Further, the pistons 23 are abutted against the magnetic coupling 22 and the respective buffer sleeves 24.

The two valves 30 are respectively and axially mounted at the two distal ends of the cylinder body 10, each comprising a buffer 31, a back cover 33, a buffer adjustment screw hole 35, a buffer loop 36, a sensor mounting groove 37, and a cap nut 38. The buffer 31 of each valve 30 is mounted in the inner edge of one respective end of the cylinder body 10, comprising a buffer body 311, an oil seal 312 and a first buffer chamber 313. The buffer body 311 surrounds the oil seal 312. The first buffer chamber 313 is defined in the buffer body 311 inside one end of the cylinder body 10. The back cover 33 of each valve 30 is mounted on the outer edge of one respective end of the cylinder body 10, comprising a cover body 331, an air hole 332, a second buffer chamber 333, an end face 334 and an outer thread 335. The cover body 331 is disposed outside one respective end of the cylinder body 10. The outer thread 335 extends around the periphery of the cover body 331. The air hole 332 is located at the cover body 331 and disposed in air communication with the second buffer chamber 333. The second buffer chamber 333 is defined in the cover body 331 and disposed adjacent to and in communication with the first buffer chamber 313. Through the air hole 332, a gas or fluid flow can be guided in and out of the cylinder body 10, causing the piston assembly 20 to reciprocate within the cylinder body 10. The buffer adjustment screw hole 35 of each valve 30 is abutted to one side of the air hole 332 and disposed in communication with the buffer loop 36 for adjusting the amount of compressed flow of air or fluid moving in and out of the air hole 332 when the piston assembly 20 reaches the second buffer chamber 333. The sensor mounting groove 37 of each valve 30 is located at the end face 334 of the back cover 33 and extending from the outer thread 335 to the second buffer chamber 333, as shown in FIGS. 1 and 2. The sensor mounting groove 37 holds a magnetic sensor 39 therein. The magnetic sensor 39 is adapted to sense the presence of the respective magnet 26 of the piston assembly 20 in the second buffer chamber 333 of the respective valve 30. The cap nut 38 of each valve 30 is threaded onto the outer thread 335 of the associating cover body 331.

The movable member 50 is mounted around the cylinder body 10 to carry a machine, comprising a magnetic coupling 51 that is secured to the magnetic coupling 22 of the piston assembly 20 so that the movable member 50 can be reciprocated with the piston assembly 20. Further, the magnetic coupling 51 comprises a plurality of alternatively arranged circular yokes 511 and circular magnets 512.

Further, the effect of the sensor mounting groove 37 is explained hereinafter with reference to FIG. 2.

When the magnet 26 of the piston assembly 20 enters the second buffer chamber 333 of the valve 30 at the left side, the respective magnetic sensor 39 senses the presence of the magnet 26 and then gives a signal to a respective electromagnetic valve (not shown) to stop the air hole 332 of the respective valve 30 at the right side from providing a compressed flow of air or fluid to the inside of the cylinder body 10. After the machine at the movable member 50 finished the assigned action, the respective magnetic sensor 39 gives a signal to the electromagnetic valve to open the air hole 332 of the respective valve 30 at the left side, providing a compressed flow of air or fluid to the inside of the cylinder body 10, at the same time, the air hole 332 of the valve 30 at the right side is controlled to discharge the compressed flow of air or fluid. Thus, the piston assembly 20 is forced to move to the second buffer chamber 333 at the right side, and vise versa.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A rodless power cylinder, comprising:

a cylinder body;

a piston assembly movable back and forth in said cylinder body, said piston assembly comprising a rod shaft, a magnetic coupling mounted around said rod shaft, two pistons mounted at said rod shaft at two opposite sides relative to the magnetic coupling of said piston assembly, and two magnets respectively located at the two distal ends of said rod shaft;

two valves respectively mounted in two distal ends of said cylinder body, each said valve comprising an air hole for guiding a flow in and out of said cylinder body, a sensor mounting groove and a magnetic sensor mounted in said sensor mounting groove for sensing one said magnet; and a movable member comprising a magnetic coupling, said movable member being mounted around the periphery of said cylinder body, the magnetic coupling of said movable member being secured to the magnetic coupling of said piston assembly by a magnetic force for enabling said movable member to be reciprocated with said piston assembly, wherein said sensor mounting groove is located on one end face of the respective said valve and extended from an outer thread around the periphery of the respective said valve to a buffer chamber in the respective said valve.

2. The rodless power cylinder as claimed in claim 1, wherein said sensor mounting groove extends to said end face.

3. The rodless power cylinder as claimed in claim 1, wherein said piston assembly further comprises two locating rods respectively extended from the two distal ends of said rod shaft, wherein said magnets are affixed to said locating rods, respectively.

4. The rodless power cylinder as claimed in claim 1, which is a pneumatic cylinder.

5. A rodless power cylinder, comprising:

a cylinder body;

a piston assembly movable back and forth in said cylinder body, said piston assembly comprising a rod shaft, a magnetic coupling mounted around said rod shaft, two pistons mounted at said rod shaft at two opposite sides relative to the magnetic coupling of said piston assembly, and two magnets respectively located at the two distal ends of said rod shaft;

two valves respectively mounted in two distal ends of said cylinder body, each said valve comprising an air hole for guiding a flow in and out of said cylinder body, a sensor mounting groove and a magnetic sensor mounted in said sensor mounting groove for sensing one said magnet; and a movable member comprising a magnetic coupling, said movable member being mounted around the periphery of said cylinder body, the magnetic coupling of said movable member being secured to the magnetic coupling of said piston assembly by a magnetic force for enabling said movable member to be reciprocated with said piston assembly, wherein said sensor mounting groove is located on one end face of the respective said valve and extended from an outer thread around the periphery of the respective said valve to a second buffer chamber in the respective said valve, wherein each said valve comprises a back cover mounted at an outer edge of one end of said cylinder body; the second buffer chamber of each said valve is defined in a cover body of the back cover of the respective said valve.

6. The rodless power cylinder as claimed in claim 5, wherein each said magnet of said piston assembly is configured to be sensed by the respective said magnetic sensor when entering the second buffer chamber of the respective said valve.

* * * * *